United States Patent [19]

Huang et al.

[11] Patent Number: 4,668,311

[45] Date of Patent: May 26, 1987

[54] RAPIDLY SOLIDIFIED NICKEL ALUMINIDE ALLOY

[75] Inventors: Shyh-Chin Huang, Latham; Keh-Minn Chang; Alan I. Taub, both of Schenectady, all of N.Y.

[73] Assignee: General Electric Company, Schenectady, N.Y.

[21] Appl. No.: 871,042

[22] Filed: Jun. 5, 1986

Related U.S. Application Data

[63] Continuation of Ser. No. 647,327, Sep. 4, 1984, abandoned.

[51] Int. Cl.[4] ..... C22C 19/00

[52] U.S. Cl. ..... 148/429; 420/460

[58] Field of Search ..... 148/403, 428, 429; 420/441, 460

[56] References Cited

U.S. PATENT DOCUMENTS 4,055,447 10/1977 Jackson ..... 148/32
4,359,352 11/1982 Ray et al. ..... 148/31
4,478,791 10/1984 Huang et al. ..... 420/590

FOREIGN PATENT DOCUMENTS 2037322 7/1980 United Kingdom .

OTHER PUBLICATIONS

Liu, C. T., White, C. L., Koch, C. C., and Lee, E. H., "Preparation of Ductile Nickel Aluminides for High Temperature Use", Proc. Electrochemical Soc. on High Temp. Mat., ed. M. Cubicciotti, 84-7, Electrochem. Soc. Inc., (1983), p. 32.

Liu, C. T. and Koch, C. C., "Development of Ductile Polycrystalline $Ni_3Al$ for High-Temperature Applications", Technical Aspects of Critical Materials Use by the Steel Industry, IIB, (1983), pp. 42-1-42-19.

*Primary Examiner*—Christopher W. Brody

*Attorney, Agent, or Firm*—Paul E. Rochford; James C. Davis, Jr.; Paul R. Webb, II

[57] ABSTRACT

A substantial increase in strength of a boron doped nickel aluminide is achieved by employing a substituent metal in the $Ni_3Al$ composition to replace a part of the aluminum. Vanadium and silicon are successfully substituted for a portion of the aluminum to provide a composition:

$$(Ni_{0.75}Al_{0.20}X_{0.05})_{99}B_1$$

where X is selected from the group consisting of vanadium or silicon.

6 Claims, 1 Drawing Figure

RAPIDLY SOLIDIFIED NICKEL ALUMINIDE ALLOY

This application is a continuation of application Ser. No. 647,327, filed Sept. 4, 1984, now abandoned

CROSS REFERENCE TO RELATED APPLICATIONS

Reference is made to the following copending applications as possibly relevant to the subject application:

"RAPIDLY SOLIDIFIED NICKEL ALUMINIDE OF IMPROVED STOICHIOMETRY AND DUCTILIZATION", Ser. No. 646,877, filed Sept. 4, 1984 now U.S. Pat. No. 4,642,139;

"METHOD FOR IMPARTING STRENGTH AND DUCTILITY TO INTERMETALLIC PHASES", Ser. No. 647,326, filed Sept. 4, 1984, now abandoned;

"$Ni_3Al$ ALLOY OF IMPROVED DUCTILITY BASED ON IRON SUBSTITUENT", Ser. No. 647,328, filed Sept. 4, 1984 now abandoned.

All of the cross-referenced applications are assigned to the same assignee as the subject application.

BACKGROUND OF THE INVENTION

By a previous application the inventors dislosed and claimed a set of alloys having a boron additive which made possible the achievement of a novel combination of strength and ductility in certain compositions. That application, Ser. No. 444,932 filed 11-29-82, now U.S. Pat. No. 4,478,791, was assigned to the same assignee as the subject application and is incorporated herein by reference.

It is pointed out in the prior application that in many systems composed of two or more metallic elements there may appear, under certain combinations of compositions and treatment conditions, phases other than the primary solid solutions. Such other phases are commonly known as intermediate phases. Many intermediate phases are referred to by means of the Greek symbol such as $\gamma$ or $\gamma'$. Also they are referred to by formula as for example, $Cu_3Al$, CuZn and $Mg_2Pb$. The compositions of the intermediate phases which have simple approximate stoichiometric ratios of the elements may exist over a range of temperatures as well as of compositions.

Occasionally as in the case of $Mg_2Pb$, which occurs in the Mg-Pb system, a true stoichiometric compound, which compound is completely ordered, is found to occur. Where each of the elements of the compound is a metallic element, the intermediate compound itself is commonly called an intermetallic compound.

The intermediate phases and intermetallic compounds often exhibit properties entirely different from those of the component metals comprising the system. They also frequently have complex crystallographic structures. The lower order of crystal symmetry and fewer planes of dense atomic population of these complex crystallographic structures may be associated with certain differences in properties, e.g. greater hardness, lower ductility, lower electrical conductivity of the intermediate phases as compared to the properties of the primary solid solutions.

Although several intermediate intermetallic compounds with otherwise desirable properties, e.g. hardness, strength, stability and resistance to oxidation and corrosion at elevated temperatures, have been identified, their characteristic lack of ductility has posed formidable barriers to their use as structural materials. In fact some of these materials are so friable that they have been prepared as solids in order that they may be broken up into powdered form for use in powder metallurgical processes for fabrication of articles.

A recent article appearing in the Japanese literature disclosed that the addition of trace amounts (0.05 to 0.1% wt. %) of boron to $Ni_3Al$ polycrystalline material was successful in improving the ductility of the otherwise brittle and non-ductile intermetallic compound. See in this regard *Journal of the Japan Institute of Metals*, Vol. 43, page 358 published in 1979 by the authors Aoki and Izumi. Although the room temperature tensile strain to fracture of the $Ni_3Al$ was improved by the boron addition to about 35%, as compared to about 3% for the $Ni_3Al$ without boron, the room temperature yield strength remained at about 30 ksi. The Japanese article did not refer at all however to rapid solidification of the boron containing compositions which they studied.

By the method of the prior application for Ser. No. 444,932 filed Nov. 29, 1982 referred to above, the addition of 0.01 to 2.5 at. % boron demonstrated further improvements where the alloy preparation included the step of rapid solidification. In particular as it is brought out in this prior application preferred properties are found in rapidly solidified compositions containing between 0.5 and 2.0% boron and an optimum combination of yield stress and strain to fracture is found in rapidly solidified compositions containing approximately 1.0% boron or less.

BRIEF STATEMENT OF THE INVENTION

It is, accordingly, one object of the present invention to provide an improved alloy for operation at higher temperatures.

Another object is to provide an alloy of nickel and aluminum capable of operating at elevated temperatures for sustained periods of time.

Another object is to provide a nickel aluminum alloy having an $Ll_2$ type crystal structure but having significant ductility and strength.

Another object is to provide an alloy of aluminum and nickel in which another element is substituted for a portion of the aluminum and which has a unique combination of physical properties.

Other objects and advantages of the present invention will be in part apparent and in part pointed out in the description which follows.

In one of its broader aspects, objects of the invention can be achieved by providing a rapidly solidified alloy composition having an $Ll_2$ crystal structure and having a composition as follows:

$$(Ni_{0.75}X_{0.05}Al_{0.20})_yB_{100-y}$$

where $98 \leqq y \leqq 99.9$ and X is a substituent metal selected from the group consisting of vanadium and silicon.

BRIEF DESCRIPTION OF THE FIGURES

The present invention and the description which follows will be made clearer by reference to the accompanying figures in which.

DETAILED DESCRIPTION OF THE INVENTION

Figure 1:
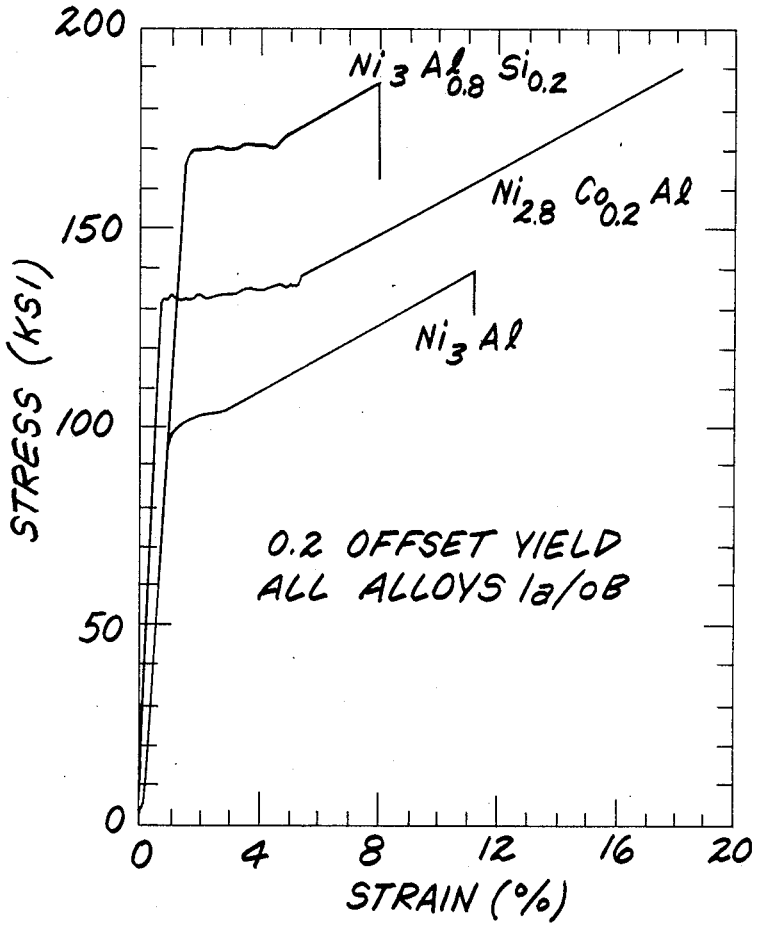
FIG. 1 is a plot of the values of the stress of the inventive alloys plotted against the strain in percent for the base $Ni_3Al$ alloy as well as alloys containing substituents for the nickel and aluminum constituents.

Surprisingly it has now been found that further property improvements are possible in the alloy system of the gamma prime $Ni_3Al$ intermediate phase where not only boron is present in the composition as a ternary element but in addition a metal selected from a group of metals is present as a quaternary ingredient of such compositions as a substituent metal.

By a substituent metal is meant a metal which takes the place of and in this way is substituted for another and different metal, where the other metal is part of a combination of metals forming an essential constituent of an alloy system.

For example, in the case of the intermediate phase system $Ni_3Al$, the constituent metals are nickel and aluminum. The metals are present in the stoichiometric atomic ratio of 3 nickel atoms for each aluminum atom in this system. It had been discovered that a desirable crystal form and accompanying superior physical properties can be achieved by forming a single crystal of $Ni_3Al$. However polycrystalline $Ni_3Al$ is quite brittle and shatters under stress such as is applied in efforts to form the material into useful objects or to use such an article.

It was discovered that the inclusion of boron in the rapidly cooled and solidified system can impart desirable ductility to the rapidly solidified alloy as taught in application Ser. No. 444,932 referred to above.

Now it has been discovered that certain metals can be beneficially substituted in part for the constituent aluminum and hence these substituted metals are designated and known herein as substituent metals i.e. as an aluminum substituent in the $Ni_3Al$ structure. Moreover it has been discovered that valuable and beneficial properties are imparted to the rapidly solidified compositions which have the stoichiometric proportions but which have a substituent metal as a quaternary ingredient of such rapidly solidified alloy systems.

The alloy compositions of the present invention must contain a first or primary ingredient or component and a second ingredient or component different from the first. The compositions must also contain boron as a tertiary ingredient as taught herein and as taught in copending application Ser. No. 444,932 referred to above, and must further contain a quaternary component or ingredient as a substituent for aluminum as taught in the subject specification.

The first constituent or ingredient is preferably nickel.

Further, the first constituent and the second constituent must be present in substantially stoichiometric atomic ratios. An example is the nickel aluminide in which three atoms are present as the primary component constituent for each aluminum constituent which is present.

The composition which is formed must have a preselected intermetallic phase having a crystal structure of the $Ll_2$ type and must have been formed by cooling the melt at a cooling rate of at least about $10^{3°}$ C. per second to form a solid body the principal phase of which is the $Ll_2$ type crystal structure in either its ordered or disordered state. The melt composition from which the structure is formed must have the first constituent and second constituent present in the melt in an atomic ratio of approximately 3:1.

As pointed out in the prior application Ser. No. 444,932 referred to above, compositions having this combination of ingredients and which are subjected to the rapid solidification technique have surprisingly high values for both the strain to fracture after yield and for the 0.2% offset yield stress. For boron levels between 1 and 2% the values of the strain to fracture generally declines so that a preferred range for the boron tertiary additive is between 0.5 and 1.5%.

By the prior teaching it was found that the optimum boron addition was at about 1 atomic percent and permitted a yield strength value at room temperature of about 100 ksi to be achieved for the rapidly solidified product. The fracture strain of such a product was about 10% at room temperature.

Surprisingly, it has now been found that the unusual strength properties which are obtained through the use of the rapid solidification in combination with the boron additive may be increased to heretofore unprecedented levels with the addition of a selected quaternary component or ingredient as a substituent to the primary aluminum component.

The quaternary ingredient which may be beneficially included in a composition for rapid solidification as a substituent to make unprecedented improvements in the properties include the elements vanadium and silicon.

Further it has been found, observed and determined that where an equiaxed structure is formed with the quaternary composition by rapid solidification, the properties are substantially better on the average than in those cases where the non-equiaxed structure is formed. The equiaxed structure is believed to result from recrystallization. It is known that recrystallization can readily occur in a single-phase material.

The addition of the vanadium or silicon as quaternary ingredient and as a substituent for aluminum at about a 5 atomic percent level apparently does not form borides or other phases under the influence of the rapid solidification processing.

Regarding the improved properties achieved in the measurements made following the preparation of the alloys, the testing of alloys as described herein has yielded some surprising results. One set of the properties and particularly the stress properties are indicated in the attached FIG. 1 in which the stress in ksi is plotted against the strain in percent.

It is evident from FIG. 1 that the alloy containing $Ni_3Al$ with 1% boron has the lowest stress values and that the two other samples which were tested had significantly and unexpectedly higher values. The sample with the 5 atomic percent silicon had the highest values found and these were of the order of 185 ksi.

In the practice of this invention, an intermetallic phase having an $Ll_2$ type crystal structure is first selected. The selection criteria will depend upon the end use environment which, in turn, determines the attributes, such as strength, ductility, hardness, corrosion resistance and fatigue strength, required of the material selected.

An intermetallic phase typical of those of engineering interest and one having particularly desirable attributes is nickel aluminide ($Ni_3Al$) which is found in the nickel-aluminum binary system and as the gamma prime phase in gamma/gamma prime nickel-base superalloys. Nickel aluminide has high hardness and is stable and resistant to oxidation and corrosion at elevated temperatures which makes it attractive as a potential structural material. Although single crystals of $Ni_3Al$ exhibit good ductility in certain crystallographic orientations, the polycrystalline form, i.e., the form of primary significance from an engineering standpoint, has low ductility and fails in a brittle manner intergranularly.

Nickel aluminide, which has an ordered face centered cubic (FCC) crystal structure of the $Cu_3Al$ type ($Ll_2$ in the Stukturbericht designation which is the designation used herein and in the appended claims) with a lattice parameter $a_o=3.589$ at 75 at. % Ni and melts in the range of from about 1385° to 1395° C., is formed from aluminum and nickel which have melting points of 660° and 1453° C., respectively. Although frequently referred to as $Ni_3Al$, nickel aluminide is an intermetallic phase and not a compound as it exists over a range of compositions as a function of temperature, e.g., about 72.5 to 77 at. % Ni (85.1 to 87.8 wt. %) at 600° C.

The selected intermetallic phase is provided as a melt whose composition corresponds to that of the preselected intermetallic phase. The melt composition will consist essentially of the atoms of the two components of the intermetallic phase in an atomic ratio of approximately 3:1 and is modified with boron in an amount of from about 0.01 to 2.5 at. %.

Generally, the components will be two different elements, but, while still maintaining the approximate atomic ratio of 3:1, one or more elements may, in some cases, be partially substituted for one or both of the two elements which form the intermetallic phase.

Although the melt should ideally consist only of the atoms of the intermetallic phase and atoms of boron, it is recognized that occasionally and inevitably other atoms of one or more incidental impurity atoms may be present in the melt.

The melt is next rapidly cooled at a rate of at least about $10^{3}$° C./sec to form a solid body, the principal phase of which is of the $Ll_2$ type crystal structure in either its ordered or disordered state. Thus, although the rapidly solidified solid body will principally have the same crystal structure as the preselected intermetallic phase, i.e., the $Ll_2$ type, the presence of other phases, e.g., borides, is possible. Since the cooling rates are high, it is also possible that the crystal structure of the rapidly solidified solid will be disordered, i.e., the atoms will be located at random sites on the crystal lattice instead of at specific periodic positions on the crystal lattice as is the case with ordered solid solutions.

There are several methods by which the requisite large cooling rates may be obtained, e.g., splat cooling. A preferred laboratory method for obtaining the requisite cooling rates is the chill-block melt spinning process.

Briefly and typically, in the chill-block melt spinning process molten metal is delivered from a crucible through a nozzle, usually under the pressure of an inert gas, to form a free-standing stream of liquid metal or a column of liquid metal in contact with the nozzle. The stream of liquid metal is then impinged onto or otherwise placed in contact with a rapidly moving surface of a chill-block, i.e., a cooling substrate, made of a material such as copper.

The material to be melted can be delivered to the crucible as separate solids of the elements required and melted therein by means such as an induction coil placed around the crucible or a "master alloy" can first be made, comminuted, and the comminuted particles placed in the crucible. When the liquid melt contacts the cold chill-block, it cools rapidly, from about $10^{3}$° C./sec to $10^{7}$° C./sec, and solidifies in the form of a continuous length of a thin ribbon whose width is considerably larger than its thickness. A more detailed teaching of the chill-block melt spinning process may be found, for example, in U.S. Pat. Nos. 2,825,108, 4,221,2517, and 4,282,921 which are herein incorporated by reference.

The following examples are provided by way of illustration and not by limitation to further teach the novel method of the invention and illustrate its many advantageous attributes:

EXAMPLE 1

A heat of a composition corresponding to about 3 atomic parts nickel to 1 atomic part aluminum and 1 atomic percent boron was prepared, comminuted, and about 60 grams of the pieces were delivered into an alumina crucible of a chill-block melt spinning apparatus. The composition had the formula:

$$(Ni_{0.75}Al_{0.25})_{99}B_1$$

The crucible terminated in a flat-bottomed exit section having a slot 0.25 (6.35 mm) inches by 25 mils (0.635 mm) therethrough. A chill block, in the form of a wheel having faces 10 inches (25.4 cm) in diameter with a (rim) thickness of 1.5 inches (3.8 cm), made of H-12 tool steel, was oriented vertically so that the rim surface could be used as the casting (chill) surface when the wheel was rotated about a horizontal axis passing through the centers of and perpendicular to the wheel faces. The crucible was placed in a vertically up orientation and brought to within about 1.2 to 1.6 mils (30–40$\mu$) of the casting surface with the 0.25 inch length dimension of the slot oriented perpendicular to the direction of rotation of the wheel.

The wheel was rotated at 1200 rpm. The melt was heated to between about 1350° and 1450° C. The melt was ejected as a rectangular stream onto the rotating chill surface under the pressure of argon at about 1.5 psi to produce a long ribbon which measured from about 40–70$\mu$ in thickness by about 0.25 inches in width.

The ribbons were tested for bend ductility and a value of 1.0 was found. This value of bend ductility designates that the ribbon can be bent fully to 180° C. without fracture.

EXAMPLE 2

The procedure of Example 1 was repeated using the same equipment to prepare a master heat of the boron doped nominal $Ni_3Al$ composition but one which was modified to the following composition:

$$(Ni_{0.75}Al_{0.20}Ti_{0.05})_{99}B_1$$

Ribbons were cast from the heat as described in Example 1.

The ribbons were tested for bend ductility and a value of 0.04 was found for the ribbon thus prepared. This value of bend ductility was calculated by dividing the ribbon thickness by the bend radius at which the ribbon fractures.

EXAMPLES 3 through 12

Ten additional master heats alloys 96, 101, 111 through 117 and 125 were prepared having the compositions as set forth in the Table I below. These heats were prepared in the manner described with reference to the first described above and were tested for bend ductility in the same manner as that prepared above. The values for bend ductility which were obtained are listed in Table I.

It was also found that there is a correlation between the full bend ductility (bend ductility = 1.0) of the samples which were prepared and the formation of an equiaxed configuration in the crystallographic structure which was formed. The Table indicates also those samples for which an equiaxed format was found and also those for which the non-equiaxed format was found.

TABLE I

| Example | Alloy Number | Composition Formula | Bend Ductility | Crystallographic Structure |
|---|---|---|---|---|
| 2 | 92 | $(Ni_{0.75}Al_{0.20}Ti_{0.05})_{99}B_1$ | 0.04 | — |
| 3 | 96 | $[(Ni_{0.75}Al_{0.25})_{0.98}Mo_{0.02}]_{99}B_1$ | 0.06 | N |
| 4 | 111 | $(Ni_{0.75}Al_{0.20}Ta_{0.05})_{99}B_1$ | 0.03 | N |
| 5 | 112 | $(Ni_{0.75}Al_{0.20}Nb_{0.005})_{99}B_1$ | 0.02 | N |
| 6 | 113 | $(Ni_{0.75}Al_{0.20}V_{0.05})_{99}B_1$ | 1.0 | E |
| 7 | 114 | $(Ni_{0.75}Al_{0.20}Si_{0.05})_{99}B_1$ | 1.0 | E |
| 8 | 115 | $(Ni_{0.65}Fe_{0.10}Al_{0.25})_{99}B_1$ | 0.9 | N |
| 9 | 116 | $(Ni_{0.65}Mn_{0.10}Al_{0.25})_{99}B_1$ | 0.04 | — |
| 10 | 117 | $(Ni_{0.70}Cr_{0.05}Al_{0.25})_{99}B_1$ | 0.06 | N |
| 11 | 125 | $[Ni_{0.75}Al_{0.25})Re_{0.03}]_{99}B_1$ | 0.1 | — |
| 12 | 101 | $(Ni_{0.70}Co_{0.05}Al_{0.25})_{99}B_1$ | 1.0 | E |

N designates non-equiaxed;
E designates equiaxed.

Returning to a consideration of the data plotted in FIG. 1, it is evident that the stress in ksi of the rapidly solidified boron doped nickel aluminide base alloy containing the silicon as a partial substituent for aluminum is substantially higher than that of the similar alloy without the substituent for the aluminum.

The stress in ksi for the vanadium modified aluminide is shown by the lower plot and this composition has a stress of 135 ksi at yield.

The stress at yield for the uppermost plot is some 37% higher at 185 ksi and this is a significant and unexpected advance in the ability of those skilled in this art to increase the tensile properties of the rapidly solidified, boron doped nickel aluminide base alloys.

It is further evident from Table I that Example 6 which involved the incorporation of the vanadium in the rapidly solidified boron doped tri-nickel aluminide as a substituent for aluminum also resulted in a composition having a bend ductility test value of 1.0. Further this composition was found to be equiaxed.

Based on comparison with other materials of Table I which are incorporated as substituents for aluminum it is evident that the silicon and vanadium provide unique and advantageous improvements in the boron doped tri-nickel aluminide of the prior application Ser. No. 444,932.

What is claimed and sought to be protected by Letters Patent of the United States is as follows:

1. A rapidly solidified boron doped nickel aluminide base alloy having a crystal structure of the $L1_2$ type said alloy comprising a composition having the formula $$(Ni_{0.75}X_{0.05}Al_{0.20})_yB_{100-y}$$

where $98 \leqq y \leqq 99.5$ and wherein the X is selected from the group consisting of vanadium and silicon.

2. The aluminide of claim 1 in which X is vanadium.

3. The aluminide of claim 1 in which X is silicon.

4. A rapidly solidified boron doped nickel aluminide base alloy having a crystal structure of the $L1_2$ type, said alloy comprising a composition having the formula $$(Ni_{0.75}X_{0.05}Al_{0.20})_{99}B_1$$

wherein the X is selected from the group consisting of vanadium and silicon.

5. The aluminide of claim 4 wherein X is silicon.

6. The aluminide of claim 4 wherein the X is vanadium.

* * * * *